United States Patent [19]

Okonogi et al.

[11] 4,228,235

[45] Oct. 14, 1980

[54] COLOR PHOTOGRAPHIC MATERIAL

[75] Inventors: Kyohei Okonogi, Odawara; Mikio Sato, Ebina; Katsuo Mogaki, Isehara; Takashi Sasaki, Hino; Takashi Uchida, Hachioji, all of Japan

[73] Assignee: Konishiroku Photo Industry Co., Ltd., Tokyo, Japan

[21] Appl. No.: 1,926

[22] Filed: Jan. 8, 1979

[51] Int. Cl.[2] ..... G03C 1/06; G03C 7/00

[52] U.S. Cl. ..... 430/542; 430/372; 430/551

[58] Field of Search ..... 96/56, 95, 76 R, 77; 430/542, 372, 551

[56] References Cited

U.S. PATENT DOCUMENTS

| | | | |
|---|---|---|---|
| T867,007 | 10/1969 | Baxendale et al. | 96/95 |
| 3,069,262 | 12/1962 | Haas | 96/3 |
| 3,519,429 | 7/1970 | Lesting | 96/56 |
| 4,080,209 | 3/1978 | Mukunoki et al. | 96/95 |

*Primary Examiner*—J. Travis Brown

*Attorney, Agent, or Firm*—Haseltine, Lake & Waters

[57] ABSTRACT

A color photographic material having stabilized dye images is described which has a compound with the formula:

where R and $R_2$ individually represent an alkyl group, R represents an n-valent organic group and n is an integer of from 1 to 6.

7 Claims, No Drawings

COLOR PHOTOGRAPHIC MATERIAL

This invention relates to a color photographic material and, more specifically, a color photographic material having stabilized dye-images.

Silver halide light sensitive materials for color photography are generally composed of a support and three types of silver halide emulsion layers for color photography selectively sensitized so as to exhibit light sensitivities to blue, green and red lights coated in this order on the support. In light sensitive materials for color films, a blue-sensitive emulsion layer, a green-sensitive emulsion layer and a red-sensitive emulsion layer are coated in this order from the side for exposure to light, and a yellow filter layer being bleachable is provided between the blue-sensitive emulsion layer and the green-sensitive emulsion layer to absorb the light transmitting through the blue-sensitive emulsion layer. In addition, it is conventional to provide other interlayers for respective purposes between each of the emulsion layers and place a protective layer as the outermost layer. In light sensitive materials for color print paper, for example, a red-sensitive emulsion layer, a green-sensitive emulsion layer and a blue-sensitive emulsion layer generally coated in this order from the side for exposure and various layers including a UV-absorption layer, interlayers and a protective layer are disposed for respective particular purposes as in the light sensitive materials for the color negative films. It is also known to dispose each of the emulsion layers in the arrangement different from the foregoings, as well as employ, in place of each of the emulsion layers different in light sensitive areas, two types of light sensitive emulsion layers having substantially the same light sensitive area sensitive to each of the color lights. In light sensitive silver halide materials for color photography, exposed silver halide particles are developed by using a primary aromatic amine compound and dye images are formed through the reaction between the oxidation products resulted from a color developer and a dye-forming coupler. In this process, a phenolic or naphtholic cyan coupler is used for the formation of cyan color images, 5-pyrazolone, pyraolinobenzimidazol, pyrazotriazol, indazolone or cyanoacetyl magenta coupler is used for magenta color images and acylacetoamide or benzoyl methane yellow coupler is used for yellow color images. These dye-forming couplers are incorporated either in the light sensitive silver halide emulsion layer for color photography or in the developer solution.

It is known that the dye images of the color photographic materials obtained as in the foregoings show a significant discoloration depending on the storing conditions where they are stored long time with being exposed by light or in the dark. Such discolorations in the former and the latter cases are generally referred to as light discoloration and dark discoloration respectively and it is desired to minimize the degree of such discoloration as low as possible in order to use the color photographic materials as recording materials for permanent storage. The discoloration-fastness of the dye images in the color photographic materials are not yet quite satisfactory at present and the degree of the discoloration differs in the cyan, magenta and yellow colors often to impair the color balance after storage. In order to overcome the above defect, choice to various couplers capable of forming dye images with less discoloration or the use of anti-discoloration agents has been proposed so far.

Various anti-light discoloration agents have been proposed on one hand since the use of the UV-absorber has no effects for the prevention of the light discoloration caused by the visible light. Anti-light discoloration agents having a phenolic hydroxy groups or capable of forming such groups upon hydrolysis are, for example, proposed such as bisphenols: in Japanese Pat. No. 31256/1973 and No. 31625/1973; pyrogallol, garlic acid and its esters or acyl derivatives in U.S. Pat. No. 3,069,262; 6-hydroxychroman in U.S. Pat. No. 3,432,300 and 3,574,627; 5-hydroxychroman derivatives in U.S. Pat. No. 3,573,050; and 6,6-dihydroxy-2,2'-bis-spirochroman in Japanese Pat. No. 20977/1974. While one of these compounds certainly exhibits a preventive effect against the light discoloration of the dye-images, it has utterly no effect for the dark discoloration even showing promoting tendency. Other compound, while showing an effectiveness for a certain period, reduces or utterly loses the effect in long storage or even produces color stains. A further compound significantly promotes the discoloration for the cyan color images although it can prevent the discoloration in the magenta color images. After all, no satisfactory results have not yet been attained at present.

It is, accordingly, an object of this invention to provide a convenient and effective process for improving the fastness of the dye images. A second object of this invention is to provide a color photographic material greatly improved in the discoloration during long storage. A third object of this invention is to provide a color photographic material whose light discoloration is much improved and the dark discoloration in the cyan color images are also improved significantly. A fourth object of this invention is to provide a color photographic material easy to obtain and of an excellent stability in color images by the incorporation of a compound having no adverse effects on other photographic additives.

The color photographic material means herein not only those light sensitive materials for color photography that are not yet exposed but also so-called color photographic materials in which dye images are formed through development.

As the results of various investigation, we have found that the foregoing purposes of this invention can be attained by the incorporation of a compound of the following general formula (hereinafter referred to as invented compound) into a color photographic materials:

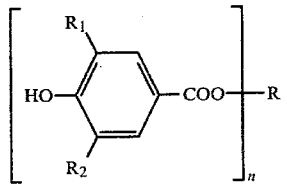

(I)

where R represents an n-valent organic group typically including n-valent aliphatic hydrocarbon radical, cycloaliphatic hydrocarbon radical, aromatic hydrocarbon radical and the like, and n is an integer from 1 to 6. The aliphatic hydrocarbon radical includes, for example, substituted or non-substituted alkyl having carbon atoms less than 20 such as methyl, ethyl, propyl octyl, dodecyl, hexadecyl, alkoxyalkyl (for example methoxyethyl), halogenated alkyl (for example, chloromethyl, 1,2-dibromoethyl, 2-chloroethyl), benzyl, phenethyl, unsaturated hydrocarbon radical (i.e. allyl, propenyl, butenyl), substituted or non-substituted alkylene radical such as ethylene, trimethylene, propylene, hexamethylene, 2-chlorotriethylene and other various radicals such as glyceryl, diglyceryl, pentaerythrityl, dipentaerythrityl and the like.

The cycloaliphatic hydrocarbon radical is a 3- to 6-membered one, for example, cyclopropyl, cyclohexyl, cyclohexenyl and the like. The aromatic hydrocarbon radical includes, for example, substituted or non-substituted aryl such as phenyl, alkylphenyl (for example p-octylphenyl, 2,4-dimethylphenyl, 2,4-di-t-amylphenyl); halogenated phenyl (for example, p-chlorophenyl, 2,4-dibromophenyl) or naphthyl; substituted or non-substituted arylene groups such as 1,2-, 1,3- and 1,4-phenylene, 3,5-diethyl-1,4-phenylene, 2-t-butyl-1,4-phenylene, 2-chloro-1,4-phenylene, naphthalene or 1,3,5-tri-substituted benzene.

In addition, the n-valent organic group usable herein further includes those n-valent organic groups in which any group in the aforementioned groups are bonded by way of the groups —O—, —S— and —$SO_2$ as shown later as the specific compound example 31.

$R_1$ and $R_2$ individually represent alkyl group (either branched or linear, preferably, those having less than 8 carbon atoms such as, for example, methyl, ethyl, propyl, butyl, amyl or hexyl, and more preferably t- or sec-butyl, amyl, hexyl or octyl).

The compounds in which n is an integer from 1 to 4 is preferably used in this invention.

Among the compounds represented by the general formula (I) in this invention, those particularly useful can be represented either in the formula:

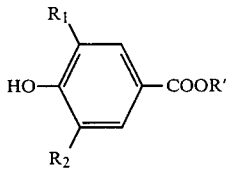

(II)

where $R_1$ and $R_2$ have the same contents as in the general formula (I), at least one of $R_1$ and $R_2$ being preferably alkyl having branches at the α-carbon atom (for example, i-propyl, t-butyl, sec-amyl, t-amyl, t-octyl), and R' represents substituted or non-substituted alkyl (such as alkyl represented by R in the general formula (I) or substituted or non-substituted aryl (such as aryl represented by R in the general formula (I)), or

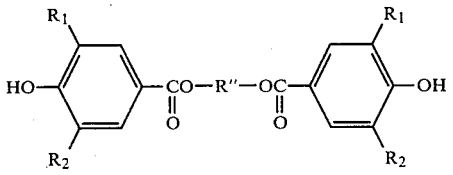

(III), where $R_1$ and $R_2$ have the same meanings as in the general formula (I), at least one of $R_1$ and $R_2$ being preferably alkyl having branches at the α-carbon atom (for example, i-propyl, t-butyl, sec-amyl, t-octyl), R'' represents substituted or non-substituted alkylene (such as alkylene represented by R in the general formula (I)) or substituted or non-substituted arylene (such as arylene represented by R in the general formula (I)).

Specific examples of the compounds according to this invention are to be set forth but in no way limitative manner.

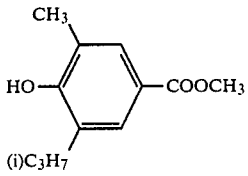

(1)

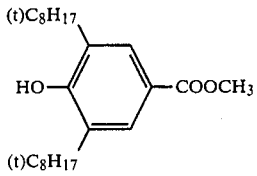

(2)

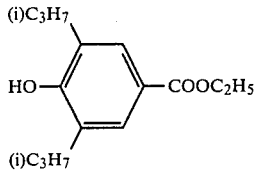

(3)

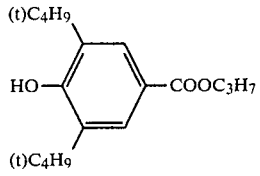

(4)

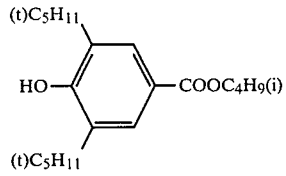

(5)

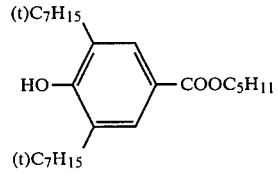

(6)

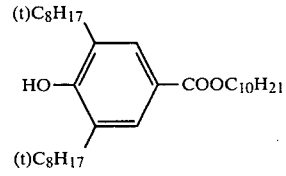

(7)

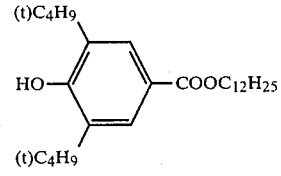

(8)

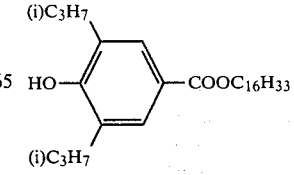

(9)

-continued
(10)
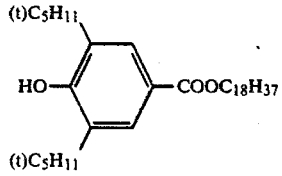
(11)
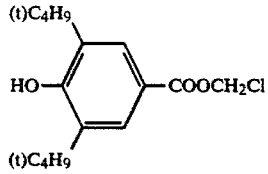
(12)
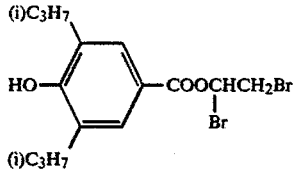
(13)
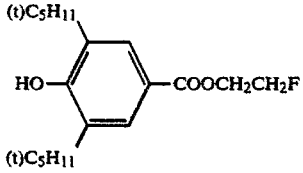
(14)
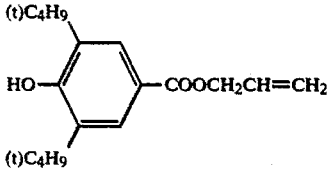
(15)
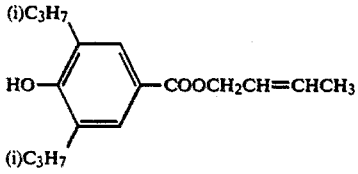
(16)
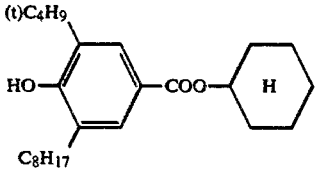
(17)
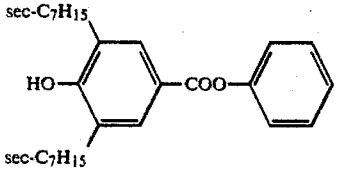
(18)
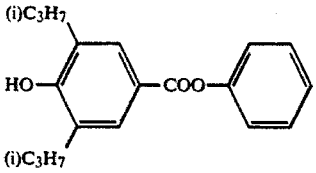
(19)
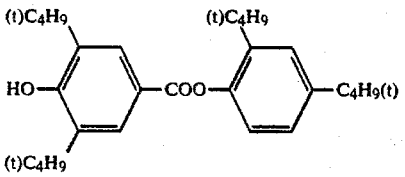
-continued
(20)
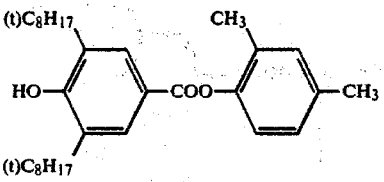
(21)
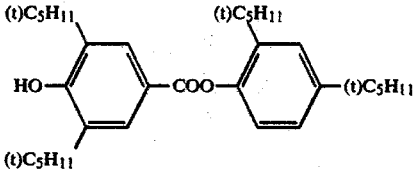
(22)
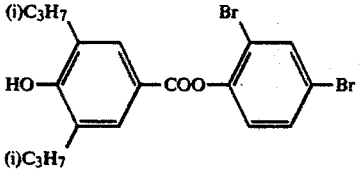
(23)
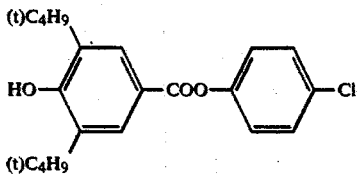
(24)
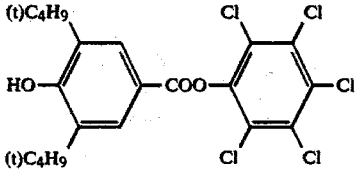
(25)
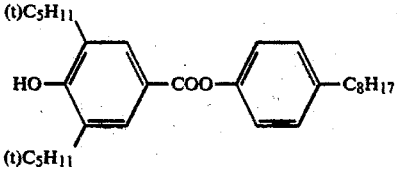
(26)
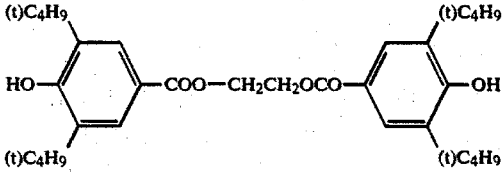
(27)
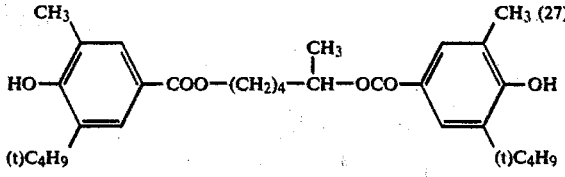
(28)
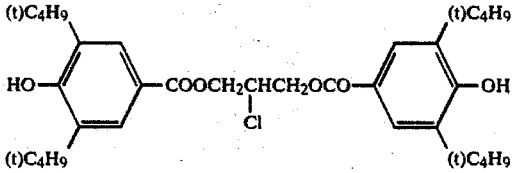

-continued

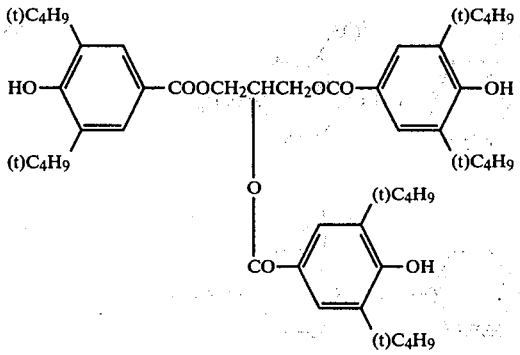

(29)

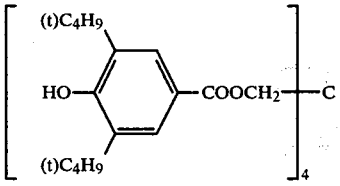

(30)

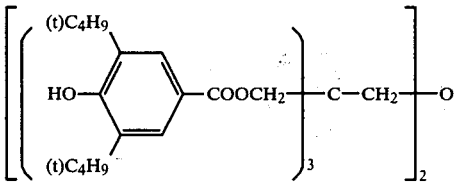

(31)

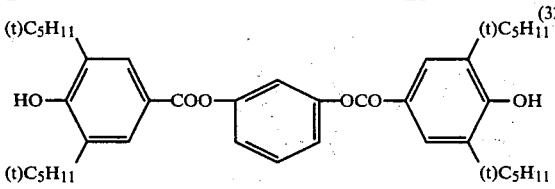

(32)

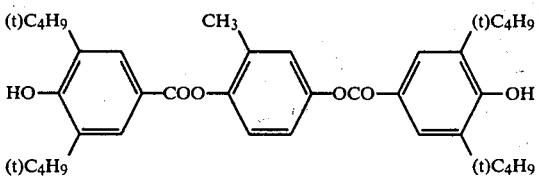

(33)

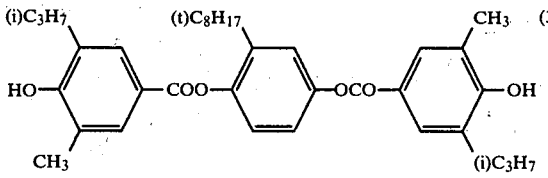

(34)

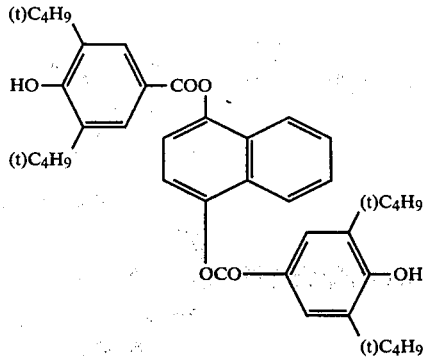

(35)

-continued

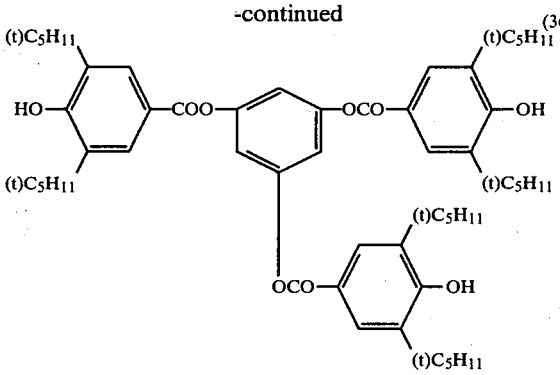

(36)

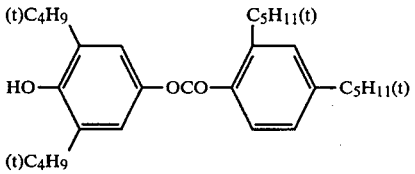

(37)

The invented compounds can be synthesized with ease through the processes as described in U.S. Pat. Nos. 3,112,338, 3,168,492 and 3,206,431 and the like.

The dye-image forming couplers used in this invention may be of various types with no particular limitations and they typically include the compounds described in the following patent literatures.

Yellow dye-image forming coupler includes acylacetoamide and benzoylmethane type 4- or 2-equivalent couplers disclosed, for example in: U.S. Pat. Nos. 2,778,658, 2,875,057, 2,908,573, 3,227,155, 3,227,550, 3,253,924, 3,265,506, 3,277,155, 3,341,331, 3,369,895, 3,384,657, 3,408,194, 3,415,652, 3,447,928, 3,551,155, 3,582,322, 3,725,072, German Patent OLS Nos. 1,547,868, 2,057,941, 2,162,899, 2,163,812, 2,213,461, 2,219,917, 2,261,361, 2,263,875, Japanese Pat. No. 13576/1974, Japanese Patent Unexamined Publication Nos. 29432/1973, 66834/1973, 10736/1974, 122335/1974, 28834/1975 and 132926/1975.

The magenta dye image-forming coupler includes 5-pyrazolone, pyrazolotriazole, pyrazolinobenzimidazole, indazolone or cyanoacetyl 4- or 2-equivalent magenta dye-forming color couplers disclosed, for example, in: U.S. Pat. Nos. 2,600,788, 3,062,653, 3,127,269, 3,311,476, 3,152,896, 3,419,391, 3,519,429, 3,558,318, 3,684,514, 3,888,680, 3,907,571, 3,928,044, 3,930,861, 3,930,866, 3,933,500, Japanese Patent Unexamined Publication Nos. 29639/1974, 111631/1974, 129538/1974, 13041/1975, Japanese Patent Application Nos. 24690/1975, 134470/1975 and 156327/1975, British Pat. No. 1,247,493, Belgian Pat. No. 792,525, U.S. Pat. No. 3,061,432, West German Pat. No. 2,156,111, Japanese Pat. No. 60479/1971, and Belgian Pat. No. 769,116.

The cyano cyan dye image-forming coupler includes phenolic or naphtholic 4- or 2-equivalent cyan dye image-forming couplers disclosed, for example in: U.S. Pat. Nos. 2,369,929, 2,423,730, 2,434,272, 2,474,293, 2,698,794, 2,706,684, 2,772,162, 2,801,171, 2,895,826, 2,908,573, 3,034,892, 3,046,129, 3,227,550, 3,253,294, 3,311,476, 3,386,301, 3,419,390, 3,458,315, 3,476,563, 3,516,831, 3,560,212, 3,582,322, 3,583,971, 3,591,383, 3,619,196, 3,632,347, 3,652,286, 3,737,326, 3,758,308, 3,779,763 and 3,839,044, German Patent OLS No. 2,163,811 and No. 2,207,468, Japanese Pat. Nos.

27563/1964 and 28836/1970, Japanese Patent Unexamined Publication Nos. 37425/1972, 10135/1975, 25228/1975, 112038/1975, 117422/1975 and 130441/1975, and Research Disclosure 1976, 14853.

The specific typical examples of the dye image-forming couplers usuable herein are to be set forth but in no way limitative manner.

YELLOW-COUPLER (Y-1)
α-benzoyl-2-chloro-5-[α-(dodecyloxycarbonyl)-ethoxy-carbonyl]-acetoanilide (Y-2)
α-benzoyl-2-chloro-5-[γ-(2,4-di-t-amylphenoxy)-butylamido]-acetoanilide (Y-3)
α-fluoro-α-pivalyl-2-chloro-5-[γ-(2,4-di-t-amylphenoxy)-butylamido]-acetoanilide (Y-4)
α-pivalyl-α-stearoyloxy-4-sulfamoyl-acetoanilide (Y-5)
α-pivalyl-α-[4-(4-benzyloxyphenylsulfonyl)-phenoxy]-2-chloro-5-[γ-(2,4-di-t-amylphenoxy)-butylamido]-acetoanilide (Y-6)
α-(2-methoxybenzoyl)-α-(4-acetoxyphenoxy)-4-chloro-2-(4-t-octylphenoxy)-acetoanilide (Y-7)
α-pivalyl-α-(3,3-dipropyl-2,4-dioxo-pyrrolidine-1-yl)-2-chloro-5-[α-(dodecyloxycarbonyl)-ethoxycarbonyl]-acetoanilide (Y-8)
α-pivalyl-α-succinimido-2-chloro-5-[γ-(2,4-di-t-amylphenoxy)butylamido]-acetoanilide (Y-9)
α-pivalyl-α-(3-tetradecyl-1-succinimido)-acetoanilide (Y-10)
α-(4-dodecyloxybenzoyl)-α-(3-methoxy-1-succinimido)-3,5-dicarboxy-acetoanilide, dipotassium acid (Y-11)
α-pivalyl-α-phthalimido-2-chloro-5-[γ-(2,4-di-t-amylphenoxy)-butylamido]-acetoanilide (Y-12)
α-2-furyl-α-phthalimido-2-chloro-5-[γ-(2,4-di-t-amylphenoxy)-butylamido]-acetoanilide (Y-13)
α-{3-[α-(2,4-di-t-amylphenoxy)-butylamido]-benzoyl}-α-succinimido-2-methoxy-acetoanilide (Y-14)
α-phthalimido-α-pivalyl-2-methoxy-4-[(N-methyl-N-octadecyl)-sulfamoyl]-acetoanilide (Y-15)
α-acetyl-α-succinimido-2-methoxy-4-[(N-methyl-N-octadecyl)-sulfamoyl]-acetoanilide (Y-16)
α-cyclobutyryl-α-(3-methyl-3-ethyl-1-succinimido)-2-chloro-5-[(2,5-di-t-amylphenoxy)-acetoamido]-acetoanilide (Y-17)
α-(3-octadecyl-1-succinimido)-α-propenoyl-acetoanilide (Y-18)
α-(2,6-di-oxo-3-n-propyl-piperidine-1-yl)-α-pivalyl-2-chloro-5-[γ-(2,4-di-t-amylphenoxy)-butylcarbamoyl]-acetoanilide (Y-19)
α-(1-benzyl-2,4-dioxo-imidazolidine-3-yl)-α-pivalyl-2-chloro-5-[γ-(2,4-di-t-amylphenoxy)-butylamido]-acetoanilide (Y-20)
α-(1-benzyl-2-phenyl-3,5-dioxo-1,2,4-triazine-4-yl)-α-pivalyl-2-chloro-5-[γ-(2,4-di-t-amylphenoxy)-butylamido]-acetoanilide (Y-21)
α-(3,3-dimethyl-1-succinimido)-α-pivalyl-2-chloro-5-[α-(2,4-di-t-amylphenoxy)-butylamido]-acetoanilide (Y-22)
α-[3-(p-chlorophenyl)-4,4-dimethyl-2,5-dioxo-1-imidazolyl]-α-pivalyl-2-chloro-5-[γ-(2,4-di-t-amylphenoxy)-butylamido]-acetoanilide (Y-23)
α-pivalyl-α-(2,5-dioxo-1,3,4-triazine-1-yl)-2-methoxy-5-[α-(2,4-di-t-amylphenoxy)-butylamido]-acetoanilide (Y-24)
α-(5-benzyl-2,4-dioxo-3-oxazolyl)-α-pivalyl-2-chloro-5-[γ-(2,4-di-t-amylphenoxy)-butylamido]-acetoanilide (Y-25)
α-(5,5-dimethyl-2,4-dioxo-3-oxazolyl)-α-pivalyl-2-chloro-5-[α-(2,4-di-t-amylphenoxy)-butylamido]-acetoanilide (Y-26)
α-(3,5-dioxo-4-oxazinyl)-α-pivalyl-2-chloro-5-[γ-(2,4-di-t-amylphenoxy)-butylamido]-acetoanilide (Y-27)
α-pivalyl-α-(2,4-dioxo-5-methyl-3-thiazolyl)-2-chloro-5-[γ-(2,4-di-t-amylphenoxy)-butylamido]-acetoanilide (Y-28)
α-[3(2H)-pyridazone-2-yl]-α-pivalyl-2-chloro-5-[γ-(2,4-di-t-amyl-phenoxy)-butylamido]-acetoanilide (Y-29)
α-[4,5-dichloro-3(2H)-pyridazone-2-yl]-α-benzoyl-2-chloro-5-[α-(dodecyloxycarbonyl)-ethoxycarbonyl]-acetoanilide (Y-30)
α-(1-phenyl-tetrazole-5-oxy)-α-pivalyl-2-chloro-5-[γ-(2,4-di-t-amylphenoxy)-butylamido]-acetoanilide (Y-31)
4,4'-di-(acetoacetoamino)-3,3'-dimethyl-diphenylmethane (Y-32)
p,p'-di-(acetoacetoamino)-diphenylmethane

MAGENTA-COUPLER (M-1)
1-(2,4,6-trichlorophenyl)-3-(2-chloro-5-octadecyl-carbamoyl-anilino)-5-pyrazolone (M-2)
1-(2,4,6-trichlorophenyl)-3-(2-chloro-5-tetradecanamido-anilino)-5-pyrazolone (M-3)
1-(2,4,6-trichlorophenyl)-3-[2-chloro-5-γ-(2,4-di-t-amylphenoxy)-butylcarbamoyl]-anilino-5-pyrazolone (M-4)
1-(2,4,6-trichlorophenyl)-4-chloro-3-[2-chloro-5-γ-(2,4-di-t-amylphenoxy)-butylcarbamoyl]-anilino-5-pyrazolone (M-5)
1-(2,4,6-trichlorophenyl)-4-diphenylmethyl-3-[2-chloro-5-(γ-octadecenylsuccinimido)-propylsulfamoyl]-anilino-5-pyrazolone (M-6)

1-(2,4,6-trichlorophenyl)-4-acetoxy-5-(2-chloro-5-tetradecanamido)-anilino-5-pyrazolone (M-7)

1-[γ-(3-pentadecylphenoxy)-butylamido]-phenyl-3-anilino-4-(1-phenyl-tetrazole-5-thio)-5-pyrazolone (M-8)

1-(2,4,6-trichlorophenyl)-3-(2-chloro-5-octadecylsuccinimido)-anilino-5-pyrazolone (M-9)

1-(2,4,6-trichlorophenyl)-3-(2-chloro-5-octadecenylsuccinimido)-anilino-5-pyrazolone (M-10)

1-(2,4,6-trichlorophenyl)-3-[2-chloro-5-(N-phenyl-N-octylcarbamoyl)]-anilino-5-pyrazolone (M-11)

1-(2,4,6-trichlorophenyl)-3-(2-chloro-5-(N-butylcarbonyl)-pyrazinylcarbonyl]-anilino-5-pyrazolone (M-12)

1-(2,4,6-trichlorophenyl)-3-[2-chloro-5-{(2,4-di-carboxy-5-phenylcarbamoyl)-benzylamido}]-anilino-5-pyrazolone (M-13)

1-(2,4,6-trichlorophenyl)-3-(4-tetradecylthiomethylsuccinimido)-anilino-5-pyrazolone (M-14)

1-(2,4,6-trichlorophenyl)-3-[2-chloro-4-(2-benzofuryl-carboxyamido)]-anilino-5-pyrazolone (M-15)

1-(2,4,6-trichlorophenyl)-3-{2-chloro-4-[γ-(2,2-dimethyl-6-octadecyl-7-hydroxy-chroman-4-yl)-propionamido]}-anilino-5-pyrazolone (M-16)

1-(2,4,6-trichlorophenyl)-3-[2-chloro-5-(3-pentadecylphenyl)-phenylcarbonylamido]-anilino-5-pyrazolone (M-17)

1-(2,4,6-trichlorophenyl)-3-[2-chloro-5-(3-t-butyl-4-hydroxyphenoxy)-tetradecanamido]-anilino-5-pyrazolone (M-18)

1-(2,4,6-dichloro-4-methoxyphenyl)-3-(2-methyl-5-tetradecanamido)-anilino-5-pyrazolone (M-19)

4,4'-benzylidenebis[1-(2,4,6-trichlorophenyl)-3-{2-chloro-4-[γ-(2,4-di-t-amylphenoxy)-butylamido]-anilino}-5-pyrazolone]

(M-20)

4,4'-benzylidenebis[1-(2,3,4,5,6-pentachlorophenyl)-3-2-chloro-5-[γ-(2,4-di-t-amylphenoxy)-butylamido]-anilino-5-pyrazolone]

(M-21)

4,4'-(2-chloro)benzylidenebis[1-(2,4,6-trichlorophenyl)-3-(2-chloro-5-dodecylsuccinimido)-anilino-5-pyrazolone]

(M-22)

4,4'-benzylidenebis[1-(2-chlorophenyl)-3-(2-methoxy-4-hexadecanamido)-anilino-5-pyrazolone]

(M-23)

4,4'-methylenebis[1-(2,4,6-trichlorophenyl)-3-(2-chloro-5-dodecenylsuccinimido)-anilino-5-pyrazolone]

(M-24)

1-(2,4,6-trichlorophenyl)-3-[3-(2,4-di-t-amylphenoxyacetoamide)-benzamido)-5-pyrazolone (M-25)

3-ethoxy-1-{4-[α-(3-pentadecylphenoxy)-butylamido]-phenyl}-b 5-pyrazolone (M-26)

1-(2,4,6-trichlorophenyl)-3-[2-chloro-5-{α-(3-t-butyl-4-hydroxy)-phenyl}-tetradecanamido]-anilino-5-pyrazolone (M-27)

1-(2,4,6-trichlorophenyl)-3-(3-nitroanilino)-5-pyrazolone

CYAN-COUPLER (C-1)

2-[α-(4-t-butylphenoxy)-butylamido]-phenol (C-2)

2-[α-(4-t-amylphenoxy)-butylamido]-5-methylphenol (C-3)

2-chloro-6-[α-(2,4-di-t-amylphenoxy)-butylamido]-phenol (C-4)

2-phenyl-6-[α-(4-t-amylphenoxy)-butylamido]-phenol (C-5)

2,4-dichloro-3-methyl-6-(di-t-amylphenoxyacetoamido)-phenol (C-6)

2,4-dichloro-3-methyl-6-[α-(2,4-di-t-amylphenoxy)-butylamido]-phenol (C-7)

2-chloro-3-methyl-4-ethylcarbamoylmethoxy-6-[α-(2,4-di-t-amylphenoxy)-butylamido]-phenol (C-8)

2-chloro-3-methyl-4-propionyloxy-6-[α-(2,4-di-t-amylphenoxy)-acetoamido]-phenol (C-9)

2-chloro-3-methyl-4-fluoro-6-[α-(2,4-di-t-amylphenoxy)-butylamido]-phenol (C-10)

2-chloro-3-methyl-4-(1-phenyl-tetrazolyl-5-thio)-6-(2-dodecyloxyphenylacetoamido)-phenol (C-11)

2,4-difluoro-3-methyl-6-[α-(3-t-butyl-4-hydroxyphenoxy)-tetradecanamido]-phenol (C-12)

2-(α,α,β,β-tetrafluoropropylamido)-4-acetoxy-6-(2,4-di-t-butylphenoxy)-acetylamido-phenol (C-13)

2,4-difluoro-3-methyl-6-[α-(2,4-di-t-amylphenoxy)-butylamido]-phenol (C-14)

2-perfluorobutylamido-5-[α-(2,4-di-t-amylphenoxy)-hexanamido]-phenol (C-15)

2-(α,α,β,β-tetrafluoropropyonamido)-5-[α-(2,4-di-t-amylphenoxy)-butylamido]-phenol (C-16)

2-(α,α,β,β-tetrafluoropropyonamido)-4-β-chloroethoxy-5-[α-(2,4-di-t-amylphenoxy)-butylamido]-phenol (C-17)

2-(α,α,β,β,γ,γ,δ,δ-octafluoropentaneamido)-5-[α-(2,4-di-t-amylphenoxy)-butylamido]-phenol (C-18)

2-(4-t-amyl-3-phenoxybenzoylamino)-3,5-dimethylphenol (C-19)

1-hydroxy-N-[δ-(2,4-di-t-amylphenoxy)butyl]-2-naphthamide (C-20)

1-hydroxy-4-(isopropylcarbamoyl)methoxy-N-[δ-(2,4-di-t-amylphenoxy)-butyl]-2-naphthamide (C-21)

1-hydroxy-4-[β-(methoxyethyl)carbamoyl]-methoxy-N-dodecyl-2-naphthamide (C-22)

1-hydroxy-4-(p-nitrophenylcarbamoyloxy)-N-[δ-(2,4-di-t-amylphenoxy)butyl]-2-naphthamide (C-23)

1-hydroxy-N-dodecyl-2-naphthamide (C-24)

1-hydroxy-4-(4-nitrophenoxy)-N-[δ-(2,4-di-t-amylphenoxy)butyl]-naphthamide (C-25)

1-hydroxy-4-(1-phenyl-5-tetrazolyloxy)-N-[δ-(2,4-di-t-amylphenoxy)butyl]-2-naphthamide (C-26)

5-(p-amylphenoxybenzensulfonamino)-1-naphthol (C-27)

5-(N-benzyl-N-naphthalenesulfonsulfonamino)-1-naphthol (C-28)

2-chloro-5-(p-nitrobenzoyl-B-O-hydroxyethylamino)-1-naphthol (C-29)

5-(1,2,3,4-tetrahydronaphthalene-6-sulfamido)-1-naphthol (C-30)

5-(quinoline-5-sulfamino)-1-naphthol (C-31)

1-hydroxy-4-acetoxy-N-[α-(2,4-di-t-amylphenoxy)-butyl]-2-naphthamide (C-32)

1-hydroxy-4-thiocyano-N-[α-(2,4-di-t-amylphenoxy)-butyl]-2-naphthamide (C-33)

1-hydroxy-4-(pentafluorophenoxy)-N-{β-{4-[α-(2,4-di-t-amylphenoxy)acetamido]-phenyl}-ethyl}-2-naphthamide (C-34)

1-hydroxy-4-(4-chlorophenoxy)-2-tetradecyloxy-2-naphthamide (C-35)

1-hydroxy-4-phthalimido-N-[α-(2,4-di-t-amylphenoxy)butyl]-2-naphthamide (C-36)

1-hydroxy-4-(dodecenylsuccinimido)-N-[δ-(2,4-di-t-amylphenoxy)butyl]-2-naphthamide (C-37)

1-hydroxy-4-phenylthio-N-[α-(2,4-di-t-amylphenoxy)butyl]-2-naphthamide

Incorporation of the invented compounds in the color photographic materials can provide a significant improvement in the anti-light discoloration effect for cyan-, magenta- and yellow dyes formed from the dye image-forming coupler, as well as a remarkable suppression for the dark discoloration in the cyan dye. Moreover, combined use of the invented compound with a conventional antidiscoloration agent can prolong the effect of the antidiscoloration agent and the combined use with an UV-absorber such as a 2-(2'-hydroxyphenyl) benzotriazole compound can maintain the effect of the UV-absorber for a long time with no degradation.

Since the compound according to this invention is oleophilic and non-diffusible in nature, it can be incorporated into a color photographic material in a very convenient manner. More specifically, it can previously be added to one or all of the photographic emulsion layers in which cyan, magenta and yellow dyes are formed through color development in the constituent layers of the silver halide light sensitive photographic material. Alternatively, it can be incorporated into other constituent layers, for example, interlayers, a yellow filter layer or an UV-absorption layer.

The effect of this invention is particularly significant when the compound according to this invention is incorporated in the layers containing the above dyes and a considerable effect can also be obtained by incorporating it into other constituent layers.

The compounds can be incorporated, for example, into the silver halide light sensitive photographic material, as in the conventional way, by dissolving in a high boiling organic solvent having a boiling point above 175° C. with additional use of the low boiling solvent, if necessary, finely dispersing in an aqueous binder such as an aqueous solution of gelatin using a surface active agent, and incorporating the dispersion into the aimed hydrophilic colloid. It is advantageous to disperse the coupler at the same time if it is oleophilic and non-dispersible, which is also advantageous in view of antidiscoloration effect. Referring more specifically to the method of incorporating the compound according to this invention, the compound according to this invention and a hydrophobic compound (coupler, UV-absorber, anticoloration agent, fluorescent whitening agent, hydroquinone derivatives mentioned hereinafter) are added at the same time into the high boiling solvent such as: organic acid amides, carbamates, esters, ketones, urea derivatives, particularly, di-n-butylphthalate, tri-cresylphosphate, di-isooctylacetate, di-n-butylsebacate, tri-n-hexylphosphate, N,N-diethylcaprylamidobutyl, n-pentadecylphenyl ether, tri-phenylphosphate, di-octylphthalate, n-nonylphenol, N,N-dilaurylamide, 3-pentadecylphenylethyl ether, 2,5-di-sec-amylphenylbutyl ether, mono-phenyl-di-o-chlorophenylphosphate, or fluoroparaffins, with the additional use, if required, of a low boiling solvent such as methyl acetate, ethyl acetate, propyl acetate, butyl acetate, butyl propionate, cyclohexanol, cyclohexane, tetrahydrofuran, methyl alcohol, ethyl alcohol, acetonitrile, dimethylformamide, dioxane, methylethyl ketone, methylisobutyl ketone, diethylene glycol monoacetate, acetylacetone, nitromethane, nitroethane, carbon tetrachloride, chloroform (these high boiling and low boiling solvents can be used alone or in admixture), mixed with an aqueous solution containing a hydrophilic binder such as gelatin containing an anionic surface active agent such as alkylbenzene sulfonate and alkylnaphthalane sulfonate and/or a nonionic surface active agent such as sorbitansesquioleate and sorbitan-monolaurate, emulsified in a high speed mixer, colloid mill or ultrasonic disperser or the like, and incorporated into the hydrophilic colloid for use.

The addition amount of the compound according to this invention has no particular restriction since the compound is substantially colorless and has no adverse effect per se such as color stains, and it is sufficient to incorporate the compound by about 15 g per mol of the dye formed upon color development. It is preferred, mainly from economical point of view, to incorporate the compound by 5–300% by weight, particularly, by 10–100% by weight to the coupler generally used in the silver halide light sensitive materials for color photography. In a silver halide light sensitive material for color photography containing no coupler, 10–100 g, particularly 15–60 g of the compound is preferred for per mol of the silver halide. While on the other hand, 1–400% by weight and, in particular, 5–200% by weight is preferred in the combined use with the UV-absorber such as 2-(2'-hydroxyphenyl) benzotriazole compound.

Two or more of the compounds according to this invention may be used in combination and the total amount for incorporation is the same as in the foregoings.

In the incorporation to the silver halide light sensitive material for color photography, the coupler to be used in the light sensitive material for color photography according to this invention is used generally by 5–50 mol% and, preferably, 10–30 mol% to the silver halide, and generally by 0.5–3.0 g/l, preferably, 1.0–2.0 g/l in the incorporation into a developer solution. Each of the yellow, magenta and cyan couplers may be used alone or in combination in two or more and the amount for the combined used is the same as in the foregoings.

Couplers other than the above couplers can be incorporated, if necessary, for particular purposes into the silver halide light sensitive material for color photography according to this invention. A colored magenta coupler, for example, can be incorporated for masking purpose. A coupler for releasing the development inhibitor depending on the density of the images upon development or a development inhibitor-releasing compound other than the coupler can be incorporated into the silver halide emulsion layers for color photography or the layers adjacent thereto.

The use of thiazolidone, benzotriazole, acrylonitrile and benzophenone series compounds as the UV-absorber together with the compound according to this invention is very advantageous in view of the prevention for discoloration due to short-wave actinic light. The use of Tinuvin PB, 320, 326, 327 and 328 (manufactured by Ciba Geigy AG) either alone or in admixture is also useful.

It is also advantageous to use hydroquinone derivatives as anti-oxidizing agent together with the compound according to this invention.

The specific examples of such hydroquinones are shown below:

Hq-1—2,5-di-t-octyl-hydroquinone;
Hq-2—2-t-octyl-5-methyl-hydroquinone;
Hq-3—2,6-di-n-dodecyl-hydroquinone;
Hq-4—2-n-dodecyl-hydroquinone
Hq-5—2,2'-methylene-bis-5,5'-di-t-butyl-hydroquinone;
Hq-6—2,5-di-n-octyl-hydroquinone;
Hq-7—2-dodecyl-carbamoylmethyl-hydroquinone;
Hq-8—2-(β-n-dodecyloxycarbonyl)ethyl-hydroquinone;
Hq-9—2-(N,N-dibutylcarbamoyl)-hydroquinone;
Hq-10—2-n-dodecyl-5-chloro-hydroquinone;
Hq-11—2-(2-octadecyl)-5-methyl-hydroquinone;
Hq-12—2,5-di-(p-methoxyphenyl)-hydroquinone;
Hq-13—2-t-octyl-hydroquinone;
Hq-14—2-[β-{3-(3-sulfobenzamido)benzamido}]ethyl-hydroquinone;
Hq-15—2,5-dichloro-3,6-diphenyl-hydroquinone;
Hq-16—2,6-dimethyl-3-t-octyl-hydroquinone;
Hq-17—2,3-dimethyl-5-t-octyl-hydroquinone;
Hq-18—2-{β-(dodecanoyloxy)ethyl} carbamoyl-hydroquinone;
Hq-19—2-dodecyloxycarbonyl-hydroquinone;
Hq-20—2-{β-(4-octanamidophenyl)ethyl}-hydroquinone;
Hq-21—2-methyl-5-dodecyl-hydroquinone.

These hydroquinones are used alone or in admixture and usually they are added preferably in an amount 0.01–10 mol, particularly 0.1–3 mol per mol of a coupler in the silver halide color photographic material containing the coupler. For the silver halide color photographic material containing no coupler, hydroquinones are preferably added in 0.01–1.0, particularly, 0.02–0.6 mol per mol of the silver halide.

The silver halide emulsion used in the silver halide light sensitive material for color photography according to this invention is generally composed of a hydrophilic colloid having dispersed therein silver halide particles. The silver halide includes silver chloride, silver bromide, silver chlorobromide, silver iodobromide, silver chloroiodobromide and the mixture of them and these silver halides can be prepared in various methods such as ammonia method, neutral method, so-called conversion method, and simultaneous mixing method. The hydrophilic colloid in which the silver halide is dispersed generally includes gelatin and gelatin derivatives such as gelatin phthalate, gelatin malonate and they can partially or wholly be replaced with albumin, agar, gum arabic, alginic acid, casein, partially hydrolyzed cellulose derivatives, partially hydrolyzed polyvinylacetate, polyacrylamide, imido-polyacrylamide, polyvinylpyrrolidone and copolymer of the above vinyl compounds. These silver halide emulsions can be optionally sensitized by using various sensitizing dyes to provide them with sensitivities to desired sensitizing wavelength area and such sensitizing dyes usable herein are cyanine dye, merocyanine dye or composite cyanine dye alone or in admixture. The following various photographic additives, if necessary, can be used either alone or in admixture: salts of noble metal such as gold, platinum, palladium, iridium, rhodium, ruthenium; chemical sensitizing agents such as sulfur compound, reducing substance, thioether compound, quarternary ammonium salt or polyalkyleneoxide compound; stabilizers such as triazoles, imidazoles, azaindenes, benzothiazoliums, zinc compounds, cadmium compounds, mercaptanes; film hardners such as chromates, zirconium salts, mucochloric acid, aldehydes, triazines, polyepoxides, active halogen compounds, ketone compounds, acryloyls, triethylenephosamide, ethyleneimine; plasticizers such as dihydroxyalkane, glycerin, 1,5-pentandiol; fluorescent whitening agents; anti-static agents; coating aids or the likes. The dispersion solution containing the compound according to this invention through dispersion is incorporated into the silver halide emulstion layer thus resulted, the dispersion according to this invention is incorporated, if required, also into an undercoat layer, anti-halation layer, interlayers, yellow filter layer, UV-absorption layer, and protective layer, and then coated over a support such as a synthetic resin film, for example, cellulose acetate, cellulose nitrate, polycarbonate, polyethyleneterephthalate or polystyrene, baryta paper, polyethylene coated paper, glass plate or the like to obtain a silver halide light sensitive material for color photography.

The silver halide light sensitive material for color photography according to this invention is applicable to a coupler-containing internal type silver halide color photographic material or an external type silver halide light sensitive material for color photography in which the coupler is contained in the developing solution, and it is particularly suitable to the coupler-containing internal type silver halide light sensitive material for color photography to be developed through color development process after exposure.

The silver halide light sensitive material for color photography is exposed and processed in an ordinary manner to form a color image. The processing fundamentarily consists of color development, bleaching and fixing.

The primary arylaromatic amine compounds, which are particularly advantageous color developing agent for use in the color development of the light sensitive silver halide material are primary phenylenediamines, aminophenols and their derivatives, typically including, for example, the followings:

N,N-dimethyl-p-phenylenediamine,
N,N-diethyl-p-phenylenediamine,
N-carbamidomethyl-N-methyl-p-phenylenediamine,
N-carbamidomethyl-N-tetrahydrofurfryl-2-methyl-p-phenylenediamine,
N-ethyl-N-carboxymethyl-2-methyl-p-phenylenediamine,
N-carbamidemethyl-N-ethyl-2-methyl-p-phenylenediamine,
N-ethyl-N-tetrahydrofurfryl-2-methyl-p-aminophenol,
3-acetylamino-4-aminodimothylaniline,
N-ethyl-N-β-methansulfonamidoethyl-4-aminoaniline,
N-ethyl-N-β-methanslfonamidoethyl-3-methyl-4-aminoaniline,
N-methyl-N-β-sulfoethyl-p-phenylenediamine,
o-aminophenol, p-aminophenol, their salts of 5-amino-2-hydroxy-toluene of inorganic acid such as hydrochloric acid and sulfuric acid or organic acid such as p-toluene flufonic acid.

The bleaching agent used in the bleaching treatment includes, ferricyanide such as red prussiate, bichromate, permanganate, hydrogen peroxide, hypochlorite, metal complex salt of aminopolycarboxylic acid such as ethylenediaminetetraacetate, nitrilotriacetic acid, metal complex salt of polycarboxylic acid such as malonic acid, tartaric acid, maleic acid, diglycolic acid, and the like, ferric chloride, and they are used either alone or in admixture as required. Various additives such as bleaching promoter can be added to the bleaching solution as required.

The fixing agents used in the fixing treatment include thiosulfates such as sodium thiosulfate, ammonium thiosulfate and urea cyanide derivatives and various additiv be incorporated such as fixing promoter as necessary.

This invention is to be described more specifically by way of examples.

EXAMPLE 1

The compounds according to this invention, yellow couplers and hydroquinone derivatives shown in Table 1—1 were dissolved in solvents also shown in the table and the resulted solution was added to 500 cc of a 5% aqueous solution of gelatin containing 3.0 g of sodium dodecylbenzenesulfonate and dispersed in a homogenizer. The resulted dispersion was incorporated into 1000 cc of a blue-sensitive silver chloroiodobromide emulsion (containing 1 mol% silver iodide and 80 mol% silver bromide). After addition of 10 ml of a methanol solution of 5% triethylene sulfonamide as a film hardener, they were applied on a polyethylene-coated paper and dried to prepare specimens. Each of the specimens, after exposed through an optical wedge, was treated according to the methods shown below. Then, the specimens were exposed to the irradiation of a Xenone Fade-O-Meter for 200 hours, and the percentage ratio ($D/Do \times 100$) of post-irradiation density (D) to pre-irradiation density ($Do=1.0$) was measured using a SAKURA COLOR densitometer (manufactured by Konishiroku Photo Industry Co., Ltd.) with blue light and the value determined was set as dye residual rate. The percentage ($D'_B/D_B \times 100$) of the post-irradiation density ($D'_B$) to the pre-irradiation density ($D_B$) in the unexposed area was measured using the blue light and the rate of increase in the yellow change (hereinafter as Y-stain) was measured. The results are shown in Table 1–2.

| Processing step (31° C.) | Processing time |
|---|---|
| Color development | 3 min. and 30 sec. |
| Bleaching fixation | 1 min. and 30 sec. |
| Water-washing | 2 min. |
| Stabilization | 1 min. |
| Drying | 1 min. |

| Formulation for color developers | |
|---|---|
| Formulation (A) | |
| benzylalcohol | 15 ml |
| diethylene glycol | 15 ml |
| fluorescent whitening agent (Whitex BB Conc. manufactured by Sumitomo Chemical Co., Ltd.) | 1 g |
| water to make up 40 ml | |
| Formulation (B) | |
| hydroxylamine sulfate | 2 g |
| Formulation (C) | |
| N-ethyl-N-β-methanesulfonamidoethyl-3-methyl-4-aminoaniline sulfate | 4.4 g |
| Formulation (D) | |
| potassium carbonate | 30 g |
| potassium bromide | 0.4 g |
| anhydrous potassium sulfite | 2 g |
| 1-hydroxyethylidene-1,1-diphosphonate (60 % solution) | 2 ml |
| potassium chloride | 0.5 g |
| p-toluenesulfonate | 10 g |

The above formulations (A), (B), (C) and (D) were successively added and compounded into a proper amount of distilled water to dissolve and make up with water to 1 l, and thereafter, pH value was adjusted to 10.1 using sodium hydroxide.

| Formulation for bleach-fix solution | |
|---|---|
| ammonium ethylenediaminetetraacetate | 61.0 g |
| diammonium ethylenediaminetetraacetate | 5.0 g |
| ammonium thiosulfate | 124.5 g |
| sodium metabisulfite | 13.3 g |
| anhydrous sodium sulfite | 2.7 g |
| water to make up 1 l | |
| aqueous ammonia to adjust pH at 7.2 | |

| Formulation for stabilization solution | |
|---|---|
| glacial acetic acid | 20 ml |
| 800 ml water added, pH adjusted to 3.5–4.0 using adding sodium acetate and made up with water to 1 l. | |

TABLE 1 - 1

| Specimen No. | Coupler add amount | | Ex. compound add amount | | Hydro-quinone derivatives add amount | | High b.p. solvent add amount | | Low b.p. solvent add amount | |
|---|---|---|---|---|---|---|---|---|---|---|
| 1 (comparison) | Y-1 | 31g | — | — | Hq-1 | 0.6g | DBP | 31cc | EA | 78cc |
| 2 | " | " | (7) | 10g | " | " | " | " | " | " |
| 3 | " | " | (13) | " | " | " | " | " | " | " |
| 4 | " | " | (18) | " | " | " | " | " | " | " |
| 5 | " | " | (19) | " | " | " | " | " | " | " |
| 6 (comparison) | Y-5 | 33g | — | — | Hq-6 | 0.6g | DBP | 33cc | EA | 83cc |
| 7 | " | " | (19) | 10g | " | " | " | " | " | " |
| 8 | " | " | (25) | " | " | " | " | " | " | " |
| 9 | " | " | (29) | " | " | " | " | " | " | " |
| 10 | " | " | (33) | " | " | " | " | " | " | " |
| 11 (comparison) | Y-6 | 35g | — | — | Hq-10 | 0.5g | TCP | 35cc | EA | 88cc |
| 12 | " | " | (10) | 7g | " | " | " | " | " | " |
| 13 | " | " | (21) | 5g | " | " | " | " | " | " |
| 14 (comparison) | Y-13 | 34g | — | — | Hq-1 | 0.6g | DBP | 34cc | EA | 85cc |
| 15 | " | " | (2) | 10g | " | " | " | " | " | " |
| 16 (comparison) | Y-19 | 38g | — | — | Hq-1 | 0.6g | DBP | 38cc | EA | 90cc |
| 17 | " | " | (10) | 8g | " | " | " | " | " | " |
| 18 | " | " | (19) | 10g | " | " | " | " | " | " |
| 19 | " | " | (21) | 7g | " | " | " | " | " | " |
| 20 | " | " | (30) | 10g | " | " | " | " | " | " |
| 21 (comparison) | Y-20 | 39g | — | — | Hq-1 | 0.6g | DBP | 39cc | EA | 92cc |
| 22 | " | " | (36) | 12g | " | " | " | " | " | " |
| 23 (comparison) | Y-25 | 36g | — | — | Hq-1 | 0.6g | DBP | 36cc | EA | 90cc |
| 24 | " | " | (19) | 10g | " | " | " | " | " | " |
| 25 | " | " | (24) | 10g | " | " | " | " | " | " |
| 26 (comparison) | Y-31 | 30g | — | — | Hq-1 | 0.6g | DBP | 30cc | EA | 75cc |
| 27 | " | " | (19) | 10g | " | " | " | " | " | " |
| 28 | " | " | (25) | " | " | " | " | " | " | " |
| 29 (comparison) | Y-32 | 28g | — | — | Hq-1 | 0.5g | DBP | 28cc | EA | 70cc |
| 30 | " | " | (7) | 10g | " | " | " | " | " | " |
| 31 | " | " | (13) | " | " | " | " | " | " | " |

In the Table (and also in the following examples) :
DBP = dibutylphthalate,
TCP = tricresylphosphate
EA = ethyl acetate

TABLE 1 - 2

| Specimen No. | Dye residual rate (%) | Y-stain increase (%) |
|---|---|---|
| 1 (comparison) | 45 | 165 |
| 2 | 84 | 110 |
| 3 | 86 | 130 |
| 4 | 85 | 120 |
| 5 | 87 | 115 |
| 6 (comparison) | 57 | 168 |
| 7 | 89 | 120 |
| 8 | 88 | 110 |
| 9 | 90 | 135 |
| 10 | 89 | 130 |
| 11 (comparison) | 65 | 140 |
| 12 | 92 | 110 |
| 13 | 91 | 100 |
| 14 (comparison) | 59 | 150 |
| 15 | 89 | 120 |
| 16 (comparison) | 60 | 162 |
| 17 | 92 | 115 |
| 18 | 93 | 130 |
| 19 | 91 | 125 |
| 20 | 90 | 125 |
| 21 (comparison) | 62 | 150 |
| 22 | 94 | 90 |
| 23 (comparison) | 52 | 170 |
| 24 | 91 | 125 |
| 25 | 90 | 130 |
| 26 (comparison) | 35 | 200 |
| 27 | 67 | 150 |
| 28 | 71 | 145 |
| 29 (comparison) | 37 | 210 |
| 30 | 64 | 135 |
| 31 | 63 | 140 |

It can be seen from the results shown in the Tables 1—1 and 1-2 that the specimens according to this invention are excellent in light stability in yellow dye images and with less light stability Y-stain.

EXAMPLE 2

Compounds according to this invention, magenta couplers, hydroquinone derivatives and anti-discoloration agents shown in Table 2-1 were dissolved in solvents shown in the table and the solution was added to 500 cc of a 5% aqueous solution of gelatin containing 2.5 g sodium dodecylbenzene sulfonate and dispersed in a homogenizer. The resulted dispersion was added to a 1000 cc green-sensitive silver bromide emulsion (containing 20 mol% silver chloride), incorporated with 10 ml of a 2% methanol solution of N,N',N''-triacryloyl-6H-S-triazine as a hardener, applied over a polyethylene-coated paper and dried to prepare respective specimens. These specimens were processed in the same manner as in Example 1 and then exposed to the irradiation of the Xenon Fade-O-Meter for 200 hours. Thereafter, the same measuring procedures were effected as in Example 1 excepting that the dye residual rate was determined using green light to obtain the results as shown in Table 2—2.

TABLE 2 - 1

| Specimen No. | Coupler add amount | | Ex. compound add amount | | Hydroquinone derivative add amount | | Anti-discoloration agent add amount | | High b.p. solvent add amount | | Low b.p. solvent add amount | |
|---|---|---|---|---|---|---|---|---|---|---|---|---|
| 1 (comparison) | M-1 | 25g | — | — | Hq-1 | 0.8g | — | — | TCP | 25cc | EA | 63cc |
| 2 | " | " | (5) | 8g | " | " | — | — | " | " | " | " |
| 3 | " | " | (19) | 8g | " | " | — | — | " | " | " | " |
| 4 | " | " | (27) | 8g | " | " | — | — | " | " | " | " |
| 5 (comparison) | M-3 | 25g | — | — | Hq-21 | 0.8g | — | — | DBP | 25cc | EA | 63cc |
| 6 | " | " | (13) | 8g | " | " | — | — | " | " | " | " |
| 7 | " | " | (20) | 8g | " | " | — | — | " | " | " | " |
| 8 (comparison) | M-6 | 20g | — | — | Hq-6 | 0.6g | — | — | DBP | 20cc | EA | 50cc |
| 9 | " | " | (19) | 7g | " | " | — | — | " | " | " | " |
| 10 (comparison) | M-9 | 27g | — | — | Hq-1 | 0.8g | — | — | DBP TCP | 14cc 13cc | EA | 68cc |
| 11 (comparison) | " | " | — | — | " | " | (1) | 8g | " | " | " | " |
| 12 (comparison) | " | " | — | — | " | " | (2) | 8g | " | " | " | " |
| 13 (comparison) | " | " | — | — | " | " | (3) | 8g | " | " | " | " |
| 14 | " | " | (19) | 4g | " | " | (3) | 8g | " | " | " | " |
| 15 | " | " | (25) | 4g | " | " | (1) | 8g | " | " | " | " |
| 16 | " | " | (19) | 8g | " | " | — | — | " | " | " | " |
| 17 | " | " | (25) | 8g | " | " | — | — | " | " | " | " |
| 18 (comparison) | M-26 | 27g | — | — | Hq-1 | 0.8g | — | — | TCP | 27cc | EA | 68cc |
| 19 | " | " | (19) | 9g | " | " | — | — | " | " | " | " |
| 20 (comparison) | M-14 | 26g | — | — | Hq-1 | 0.8g | — | — | DBP | 26cc | EA | 65cc |
| 21 | " | " | (17) | 8g | " | " | — | — | " | " | " | " |
| 22 (comparison) | M-15 | 29g | — | — | Hq-1 | 0.9g | — | — | TCP | 29cc | EA | 73cc |
| 23 | " | " | (21) | 8g | " | " | — | — | " | " | " | " |
| 24 (comparison) | M-17 | 31g | — | — | Hq-1 | 0.9g | — | — | DBP | 31cc | EA | 78cc |
| 25 | " | " | (33) | 10g | " | " | — | — | " | " | " | " |
| 26 (comparison) | M-21 | 24g | — | — | Hq-1 | 0.7g | — | — | DBP TCP | 12cc 12cc | EA | 60cc |
| 27 | " | " | (10) | 8g | " | " | — | — | " | " | " | " |
| 28 (comparison) | M-23 | 26g | — | — | Hq-1 | 0.8g | — | — | DBP TCP | 13cc 13cc | EA | 65cc |
| 29 | " | " | (19) | 8g | " | " | — | — | " | " | " | " |
| 30 | " | " | (36) | 8g | " | " | — | — | " | " | " | " |
| 31 (comparison) | M-24 | 24g | — | — | Hq-21 | 0.8g | — | — | TCP | 24cc | EA | 60cc |
| 32 | " | " | (5) | 8g | " | " | — | — | " | " | " | " |
| 33 | " | " | (19) | 8g | " | " | — | — | " | " | " | " |
| 34 | " | " | (23) | 8g | " | " | — | — | " | " | " | " |
| 35 (comparison) | M-25 | 22g | | | Hq-3 | 0.7g | — | — | DBP | 22cc | EA | 55cc |
| 36 | " | " | (17) | 7g | " | " | — | — | " | " | " | " |
| 37 | " | " | (21) | 7g | " | " | — | — | " | " | " | " |

The discoloration agents (1), (2) and (3) used in this example is (1) 2,2,4-trimethyl-6-hydroxy-7-t-octylchroman (example compound disclosed U.S. Pat. No. 3,432,300), (2) 6,6'-di-hydroxy-4,4,7,4',4',7'-hexamethyl-bis-2,2'-spirochroman (example compound disclosed in Japanese Pat. No. 20977/1965) and (3) 2,2'-methyl-bis-(4,4'-dimethyl-6,6'-di-t-butylphenol (example compound disclosed in Japanese Pat. No. 31256/1973).

The low boiling solvent MA means methyl acetate.

TABLE 2 - 2

| Specimen No. | Dye residual rate (%) | Y-stain increase (%) |
|---|---|---|
| 1 (comparison) | 45 | 380 |
| 2 | 79 | 185 |
| 3 | 82 | 160 |
| 4 | 78 | 170 |
| 5 (comparison) | 39 | 390 |
| 6 | 77 | 190 |
| 7 | 81 | 185 |
| 8 (comparison) | 45 | 345 |
| 9 | 82 | 145 |
| 10 (comparison) | 42 | 320 |
| 11 (comparison) | 80 | 235 |
| 12 (comparison) | 78 | 240 |
| 13 (comparison) | 65 | 235 |
| 14 | 82 | 150 |
| 15 | 81 | 130 |
| 16 | 82 | 140 |

TABLE 2 - 2-continued

| Specimen No. | Dye residual rate (%) | Y-stain increase (%) |
|---|---|---|
| 17 | 83 | 135 |
| 18 (comparison) | 35 | 395 |
| 19 | 79 | 215 |
| 20 (comparison) | 42 | 370 |
| 21 | 83 | 175 |
| 22 (comparison) | 51 | 260 |
| 23 | 90 | 115 |
| 24 (comparison) | 48 | 305 |
| 25 | 89 | 120 |
| 26 (comparison) | 49 | 320 |
| 27 | 88 | 145 |
| 28 (comparison) | 53 | 290 |
| 29 | 93 | 105 |
| 30 | 91 | 120 |
| 31 (comparison) | 31 | 260 |
| 32 | 65 | 210 |
| 33 | 67 | 225 |
| 34 | 66 | 190 |
| 35 (comparison) | 38 | 520 |
| 36 | 68 | 230 |
| 37 | 67 | 250 |

As apparent from the results shown in the Table 2—2, the specimens according to this invention were excellent in light stability for magenta dye-images and with less increase in the light stability Y-stain. Their effects showed no degradation in the combined use with known anti-discoloration agents.

EXAMPLE 3

The compounds according to this invention, cyan couplers, hydroquinone derivatives and UV-absorbers shown in Table 3-1 were dissolved into solvents shown in the table and the solution was added to 500 cc of a 5% aqueous gelatin solution containing 30 g sodium dodecylbenzenesulfonate and dispersed in a homogenizer. The resulted dispersion was added to 1000 cc of a red-sensitive silver halide emulsion (containing 20 mol% silver chloride), incorporated with 20 ml of a 4% aqueous solution of 2,4-dichloro-6-hydroxy-S-sodium triazine as a hardener, applied over a polyethylene-coated paper and dried to prepare specimens. These specimens were processed in the same manner as in Example 1 and irradiated under a Xenon Fade-O-Meter for 200 hours. Thereafter, the dye residual rate was determined using red light and the increase in Y-stain was determined in the same manner as described in Example 1 to obtain the results as shown in Table 3-2. In addition, the specimens treated in the same manner as above were stored in the dark at 80 RH% and at 70° C. for 21 days and, thereafter, further stored for 14 days under substantially dried condition at 77° C. Then, the dye residual rate was determined in the same way as in the foregoings to obtain the results as shown in Table 3—3.

The references have the same meanings in the following examples.

TABLE 3 - 2

| Specimen No. | Dye residual rate (%) | Y-stain increase (%) |
|---|---|---|
| 1 (comparison) | 85 | 170 |
| 2 (comparison) | 87 | 130 |
| 3 (comparison) | 90 | 120 |
| 4 | 96 | 110 |
| 5 | 97 | 105 |
| 6 | 93 | 120 |
| 7 | 92 | 115 |
| 8 (comparison) | 86 | 190 |
| 9 (comparison) | 88 | 160 |
| 10 | 92 | 130 |
| 11 | 94 | 110 |
| 12 (comparison) | 52 | 140 |
| 13 | 90 | 90 |
| 14 (comparison) | 51 | 260 |
| 15 | 89 | 120 |
| 16 (comparison) | 68 | 180 |
| 17 | 92 | 110 |
| 18 (comparison) | 86 | 170 |
| 19 | 91 | 130 |
| 20 (comparison) | 72 | 180 |
| 21 | 92 | 110 |
| 22 (comparison) | 55 | 250 |
| 23 | 88 | 150 |
| 24 (comparison) | 54 | 220 |
| 25 | 90 | 140 |
| 26 (comparison) | 53 | 240 |
| 27 | 88 | 110 |
| 28 (comparison) | 59 | 260 |
| 29 | 91 | 120 |
| 30 (comparison) | 51 | 250 |
| 31 | 91 | 130 |

TABLE 3 - 1

| Specimen No. | Coupler add amount | | Example compound add amount | | UV-absorber add amount | | Hydro-quinone derivative add amount | | High b.p. solvent add amount | | Low b.p. solvent add amount | |
|---|---|---|---|---|---|---|---|---|---|---|---|---|
| 1 (comparison) | C-5 | 21g | — | — | — | — | Hq-1 | 0.3g | DBP | 10cc | EA | 53cc |
| 2 (comparison) | " | " | — | — | T-PS<br>T-320<br>T-326 | 35g<br>35g<br>35g | " | " | " | " | EA | 53cc |
| 3 (comparison) | " | " | — | — | T-327 | 35g | " | " | " | " | " | " |
| 4 | " | " | (5) | 7g | — | — | " | " | " | " | " | " |
| 5 | " | " | (19) | 7g | — | — | " | " | " | " | " | " |
| 6 | " | " | (21) | 7g | — | — | " | " | " | " | " | " |
| 7 | " | " | (19)<br>(21) | 35g<br>35g | — | — | " | " | " | " | " | " |
| 8 (comparison) | C-6 | 22g | — | — | — | — | Hq-1 | 0.3g | DBP | 11cc | EA | 55cc |
| 9 (comparison) | " | " | — | — | T-328 | 7g | " | " | " | " | " | " |
| 10 | " | " | (20) | 7g | — | — | " | " | " | " | " | " |
| 11 | " | " | (19) | 7g | T-326 | 7g | " | " | DBP | 22cc | EA | 63cc |
| 12 (comparison) | C-15 | 25g | — | — | — | — | Hq-1 | 0.3g | TCP | 12cc | EA | 63cc |
| 13 | " | " | (13) | 8g | — | — | " | " | " | " | " | " |
| 14 (comparison) | C-17 | 30g | — | — | — | — | Hq-1 | 0.3g | DBP | 15cc | EA | 75cc |
| 15 | " | " | (21) | 10g | — | — | " | " | " | " | " | " |
| 16 (comparison) | C-3 | 30g | — | — | — | — | Hq-1 | 0.3g | TCP | 15cc | EA | 75cc |
| 17 | " | " | (3) | 10g | — | — | " | " | " | " | " | " |
| 18 (comparison) | C-7 | 22g | — | — | — | — | Hq-1 | 0.3g | DBP | 11cc | EA | 55cc |
| 19 | " | " | (25) | 7g | — | — | " | " | " | " | " | " |
| 20 (comparison) | C-11 | 25g | — | — | — | — | Hq-1 | 0.3g | DBP | 12cc | EA | 63cc |
| 21 | " | " | (30) | 8g | — | — | " | " | " | " | " | " |
| 22 (comparison) | C-18 | 22g | — | — | — | — | Hq-1 | 0.3g | TCP | 11cc | EA | 55cc |
| 23 | " | " | (8) | 7g | — | — | " | " | " | " | " | " |
| 24 (comparison) | C-20 | 25g | — | — | — | — | Hq-1 | 0.3g | DBP | 12cc | EA | 63cc |
| 25 | " | " | (19) | 8g | — | — | " | " | " | " | " | " |
| 26 (comparison) | C-22 | 25g | — | — | — | — | Hq-1 | 0.3g | DBP | 12cc | EA | 63cc |
| 27 | " | " | (16) | 8g | — | — | " | " | " | " | " | " |
| 28 (comparison) | C-25 | 23g | — | — | — | — | Hq-1 | 0.3g | DBP | 11cc | EA | 58cc |
| 29 | " | " | (28) | 7g | — | — | " | " | " | " | " | " |
| 30 (comparison) | C-35 | 24g | — | — | — | — | Hq-1 | 0.3g | DBP | 12cc | EA | 60cc |
| 31 | " | " | (6) | 8g | — | — | " | " | " | " | " | " |

In the table above :
T-PS = Tinubin PS (commercial name of Ciba Geigy AG) for 2-(2'-hydroxy-5'-t-butylphenyl)benzotriazole;
T-320 = 2-(2'-hydroxy-3',5'-t-butylphenyl)benzotriazole;
T-326 = 2-(2'-hydroxy-3'-t-butyl-5'-methylphenyl)-5-chlorobenzotriazole;
T-327 = 2-(2'-hydroxy-3,5'-di-t-butylphenyl)-5-chloro-benzotriazole;
T-328 = 2-(2'-hydroxy-3,6-di-t-amylphenyl)benzotriazole.

TABLE 3 - 3

| Specimen No. | Dye residual rate (%) 70° C. 80 RH % 21 days | 77° C. for 14 days |
|---|---|---|
| 1 (comparison) | 48 | 35 |
| 2 (comparison) | 63 | 47 |
| 3 (comparison) | 67 | 50 |
| 4 | 71 | 52 |
| 5 | 75 | 55 |
| 6 | 77 | 56 |
| 7 | 78 | 58 |
| 8 (comparison) | 52 | 39 |
| 9 (comparison) | 64 | 48 |
| 10 | 79 | 58 |
| 11 | 85 | 64 |
| 12 (comparison) | 68 | 50 |
| 13 | 83 | 71 |
| 14 (comparison) | 70 | 51 |
| 15 | 88 | 75 |
| 16 (comparison) | 42 | 31 |
| 17 | 71 | 54 |
| 18 (comparison) | 50 | 38 |
| 19 | 74 | 57 |
| 20 (comparison) | 68 | 48 |
| 21 | 85 | 69 |
| 22 (comparison) | 61 | 45 |
| 23 | 81 | 63 |
| 24 (comparison) | 72 | 53 |
| 25 | 84 | 65 |
| 26 (comparison) | 73 | 51 |
| 27 | 81 | 63 |
| 28 (comparison) | 69 | 50 |
| 29 | 85 | 69 |
| 30 (comparison) | 74 | 55 |
| 31 | 86 | 68 |

As apparent from the above Tables 3-2 and 3—3, the specimens according to this invention are excellent in the light, humidity and heat stability in the cyan dye images.

While in the comparison specimens 2, 3 and 9 containing only the benzotriazole compounds, hydrophobic substances were deposited on the surface to form matting after application and drying, the specimens according to this invention showed no surface deposition of the hydrophobic substances to indicate excellent solubility and dispersibility of the invented compounds to the organic solvents.

Further, the specimen 11 containing the benzotriazole compound and the compound according to this invention in combination also showed no surface deposition of the hydrophobic substances to maintain the UV-absorption effect of the benzotriazole compound as the UV-absorber for a long time with no degradation.

EXAMPLE 4

Each of the following layers shown below was successively coated on a polyethylene-coated paper from the side of a support to prepare a light sensitive silver halide color photographic material to be used as a specimen.

First layer: Blue-sensitive silver halide emulsion containing a yellow coupler

A silver chloroiodobromide emulsion containing 1 mol% silver iodide and 80 mol% silver bromide having 400 g gelatin per mol of the silver halide, and comprising $2\times10^{-1}$ mol yellow coupler (Y−20) per 1 mol of the silver halide sensitized with $2.5\times10^{-4}$ mol of a sensitizing dye, based on 1 mol of the silver halide, of the following structure:

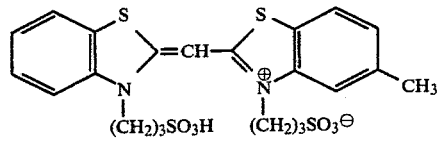

and dissolved to disperse into dibutylphthalate, and a mixture of the compound (19) according to this invention and hydroquinone derivative (Hq-1) respectively dissolved into dibutylphthalate by 30 and 2% by weight to the coupler was coated so as to provide a silver quantity of 400 mg/m$^2$.

Second layer: Gelatin layer coated to 1$\mu$ dry film thickness.

Third layer: Green-sensitive silver halide emulsion containing magenta coupler.

A silver chlorobromide emulsion containing 80 mol% silver bromide having 500 g gelatin per mol of the silver halide and comprising $2\times10^{-1}$ mol magenta coupler (M-19) per mol of the silver halide sensitized with $2.5\times10^{-4}$ mol of a sensitizing dye, based on 1 mol of the silver halide, of the following structure:

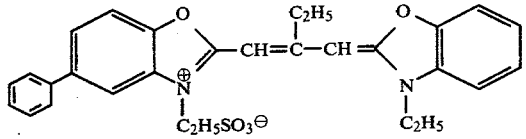

and dissolved to disperse into a solvent consisting of dibutylphthalate and tricresylphosphate in 2:1 ratio and a mixture of anti-discoloration agent: 2,2-methylene-bis-(4,4'-dimethyl-6,6'-t-butylphenol), the compound (19) according to this invention and hydroquinone derivative (Hq-1) dissolved to disperse respectively in 25, 10 and 3% by weight of the coupler into a solvent consisting of dibutylphthalate and tri-cresylphosphate in 2:1 ratio was coated so as to provide silver quantity of 300 mg/m$^2$.

Fourth layer: A gelatin layer containing 30 mg/m$^2$ hydroquinone derivative (Hq-1), UV-absorber: 100 mg/m$^2$ T-PS, 300 mg/m$^2$ T-320 and 200 mg/m$^2$ T-327, and 200 mg/m$^2$ compound (19) according to this invention dissolved to disperse into dibutylphthalate, and containing 300 mg/m$^2$ diffusion resistant and water-soluble fluorescent whitening agent of the following structure:

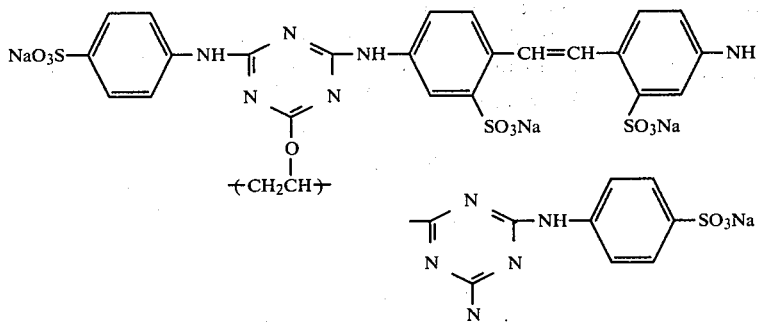

was coated to 1μ dry thickness.

Fifth layer: Red-sensitive silver halide emulsion layer containing cyan coupler.

A silver chlorobromide emulsion containing 80 mol% silver bromide having 500 g gelatin per mol of the silver halide and comprising $3\times10^{-1}$ mol cyan coupler (C-6) per mol of the silver halide sensitized with $2.5\times10^{-4}$ mol of a sensitizing dye, based on 1 mol of the silver halide, of the following structure:

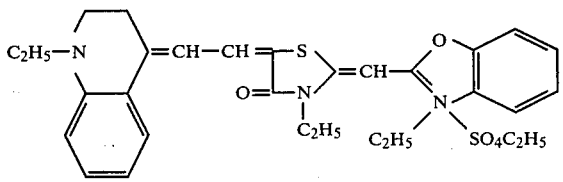

and dissolved to disperse into dibutylphthalate and a mixture of the compound (19) according to this invention, and the hydroquinone derivative (Hq-1) dissolved to disperse into dibutylphthalate respectively by 35 and 0.7% by weight of the coupler was coated so as to provide silver quantity of 500 mg/m$^2$.

Sixth layer: A gelatin layer was coated to 1μ dry thickness.

The silver halide emulsions used in each of the light sensitive layers (first, second and third layers) were prepared in the methods as described in Japanese Pat. No. 7772/1971, chemically sensitized respectively using sodium thiosulfate pentahydrate and incorporated with 4-hydroxy-6-methyl-1,3,3a,7-tetraazaindene as a stabilizer, bis-(vinylsulfomethyl)ether as a film hardener and saponin as a coating aid.

Then, the comparison specimen—1 was prepared quite in the same manner as in the specimen 1 excepting that the compound (19) according to this invention was excluded from each of the layers (first, third, fourth and fifth layers).

The comparison specimen—2 was prepared quite in the same manner as in the specimen—1 excepting that the compound (19) according to this invention was excluded respectively from each of the layers (first, third, fourth and fifth layers) and UV-absorbers T-326 and T-327 were dispersed to incorporate each in 10 and 15% by weight of the cyan coupler into the red-sensitive emulsion layer (fifth layer) together with the cyan coupler.

Each of the specimens prepared in the foregoing manners was exposed to blue, green and red light respectively through an optical wedge according to a sensimetry method and then treated in the same manner as in Example 1 excepting the stabilization bath treatment. Then, they were irradiated from a Xenon lamp Fade-O-Meter for 100 and 200 hours and the dye residual rate and the increase in Y-stain in the unexposed area were determined in the methods as described in Examples 1-3 to obtain the results as shown in Table 4-1.

The specimens as treated above were stored under 80% RH at 70° C. and in the dry dark at 77° C. for 20 and 10 days respectively and the dye residual rate was measured in the method as in Examples 1-3 to obtain the results shown in Table 4-2.

The spectral reflection rate in the unexposed white area of the specimens treated as above was measured using Hitachi 607 Color Analyzer (manufactured by Hitachi Ltd.) to obtain the results as shown in Table 4-3.

The reduction in the spectral reflectivity dues to color stains and the effect of the fluorescent bleaching agent is significantly exhibited, in particular, in the spectral reflectivity near 400 nm. The reduction in the spectral reflectivity near the above wavelength area therefore shows the hindrance to the bleaching effect and the Y-stains.

TABLE 4 - 1

| Irradiation time | Dye residual rate (%) | | | | | | Y-stain increase (%) | |
|---|---|---|---|---|---|---|---|---|
| Specimen | yellow | | magenta | | cyan | | | |
| No. | 100 | 200 | 100 | 200 | 100 | 200 | 100 | 200 |
| 1 | 92 | 80 | 89 | 72 | 93 | 84 | 360 | 520 |
| Comparison specimen - 1 | 88 | 72 | 83 | 65 | 92 | 84 | 390 | 580 |
| Comparison specimen - 2 | 93 | 78 | 86 | 70 | 94 | 85 | 370 | 530 |

TABLE 4 - 2

| Degradation condition | Dye residual rate (%) | | | | | |
|---|---|---|---|---|---|---|
| Specimen | 70° C., 80 RH % for 20 days | | | 77° C. for 10 days | | |
| No. | yellow | magenta | cyan | yellow | magenta | cyan |
| 1 | 84 | 94 | 70 | 91 | 93 | 68 |
| Comparison specimen - 1 | 85 | 89 | 58 | 80 | 82 | 41 |
| Comparison specimen - 2 | 85 | 88 | 70 | 80 | 82 | 67 |

TABLE 4 - 3

| Specimen | Spectral reflectivity (%) | | | Measured wavelength |
|---|---|---|---|---|
| No. | 440 nm | 540 nm | 640 nm | 740 nm |
| 1 | 92 | 88 | 83 | 87 |
| Comparison specimen - 1 | 92 | 88 | 83 | 87 |

TABLE 4 - 3-continued

| Specimen No. | Spectral reflectivity (%) 440 nm | 540 nm | 640 nm | Measured wavelength 740 nm |
|---|---|---|---|---|
| Comparison specimen - 2 | 82 | 86 | 83 | 87 |

As apparent from the Tables 4-1 and 4-2, the specimens according to this invention have excellent stability to light, humidity and heat.

It is also apparent from the Table 4-3 that while the comparison specimen—2 containing 2-(2'-hydroxyphenyl)benzotriazole compound conventionally known as an anti-dark discoloration agent for cyan dye image provides only a low spectral reflectivity and acts to eliminate the effect of the fluorescent whitening agent and result in Y-stains, the compounds according to this invention are excellent anti-dark discoloration agent having no such disadvantages.

EXAMPLE 5

12.5 g Of the compound (19) according to this invention was dissolved in 11 g dibutylphthalate and 30 g ethylacetate and the solution was added into 120 cc of a 5% aqueous gelatin solution containing sodium dodecylbenzenesulfonate and dispersed in a homogenizer. The resulted dispersion was added to 300 cc green-sensitive silver chlorobromide emulsion (containing 30 mol% silver chloride) and then coated over a polyethylene-coated paper and dried to obtain silver halide light sensitive photographic material. A specimen with no incorporation of the compound (19) according to this invention was prepared as a blank in the same manner.

The light sensitive silver halide photographic material was exposed through an optical wedge according to a sensimetry method and, thereafter, treated in the following procedures at a temperature of 24° C.

Processing step:

| | |
|---|---|
| first development | 5 min. |
| water-washing | 4 min. |
| exposure | |
| color development | 3 min. |
| water-washing | 4 min. |
| bleacing | 4 min. |
| fixing | 4 min. |
| water-washing | 10 min. |

Treating solutions of the following formulations were used for the first developer, color developer, bleaching solution and fixing solutions.

Formulation for first developer

| | |
|---|---|
| anhydrous sodium bisulfite | 80 g |
| phenidone | 0.35 g |
| anhydrous sodium sulfite | 37.0 g |
| hydroquinone | 5.5 g |
| anhydrous sodium carbonate | 28.2 g |
| sodium thiocyanate | 1.38 g |
| anhydrous sodium bromide | 1.30 g |
| potassium iodide (0.1 % aqueous solution) | 130 ml |
| water to make up 1 l (pH : 9.9) | |

Formulation for color developer

| | |
|---|---|
| anhydrous sodium sulfite | 10.0 g |
| N,N'-diethyl-p-phenylenediamine hydrochloride | 3.0 g |
| 1-(2,4,6-trichlorophenyl)-3-(3-nitroanilino)-5-pyrazolone magenta coupler | 1.5 g |
| water to make up 1 l and hydroxide sodium to adjust pH at 11.5 | |

Formulation for bleaching solution

| | |
|---|---|
| anhydrous sodium bromide | 43.0 g |
| potassium ferricyanide | 165.0 g |
| borax ($Na_2B_4O_7 . 10H_2O$) | 1.2 g |
| water to make up 1 l | |

Formulation for fixing solution

| | |
|---|---|
| sodium thiosulfate pentahydrate | 200 g |
| anhydrous sodium sulfite | 100 g |
| anhydrous disodium phosphate | 15.0 g |
| water to make up 1 l | |

The resulted color photographic material was exposed to the irradiation of a Xenon Fade-O-Meter for 200 hours in the same manner as in Example 2 and, thereafter, the discoloration in the dye and the Y-stain increase in the unexposed area were determined.

The results are shown in Table 5.

TABLE 5

| | Dye residual rate (%) | Y-stain increase (%) |
|---|---|---|
| Blank | 42 | 2800 |
| Specimen (invention) | 71 | 1900 |

It can be seen from the results in the Table 5 that the compound according to this invention exhibits a preventive effect against the light discoloration even when no coupler is contained in the light sensitive silver halide photographic material.

What we claim is:

1. A color photographic material comprising a support and a light sensitive silver halide emulsion layer thereon, which material comprises a compound represented by the folllowing formula:

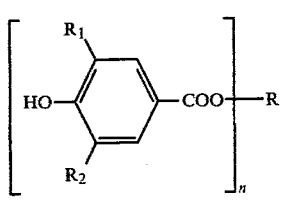

(I), where $R_1$ and $R_2$ individually represent an alkyl group, R represents a n-valent organic group selected from the group consisting of an aliphatic, cycloaliphatic and aromatic group and n is an integer from 1 to 6.

2. A color photographic material as defined in claim 1, wherein n is an integer from 1 to 4.

3. A color photographic material as defined in claim 2, wherein said compound represented by the general formula (I) is a compound represented by the following general formula:

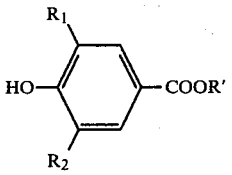

(II)

where $R_1$ and $R_2$ individually represent an alkyl group, R' represents an alkyl or aryl group, or

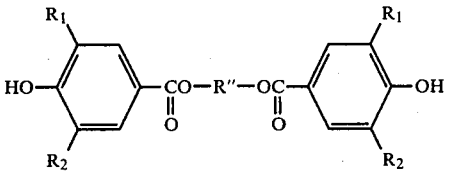

(III), where $R_1$ and $R_2$ individually represent an alkyl group and R" represents an alkylene or arylene radical.

4. A color photographic material as defined in claim 3, wherein said compound represented by the general formula (I) is a compound represented by the following general formula:

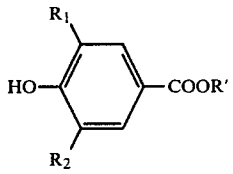

(II)

where $R_1$ and $R_2$ individually represent an alkyl group, R' represents an alkyl or aryl group.

5. A color photographic material as defined in claim 4, wherein R' represents an aryl group.

6. A color photographic material as defined in claim 5 wherein R' represents a phenyl group.

7. A color photographic material as defined in claim 1 wherein the n-valent group is selected from the group consisting of an alkyl radical having less than 20 carbon atoms, an unsaturated hydrocarbon radical, an alkylene radical, a glyceryl radical, a diglyceryl radical, a pentaerithrityl radical, a dipentaerithrityl radical, a $C_3$ - to $C_6$- cycloaliphatic hydrogcarbon radical and an aryl radical.

* * * * *